United States Patent [19]

Wolber et al.

[11] 4,416,550

[45] Nov. 22, 1983

[54] DRIVE ASSEMBLY FOR A TIMEPIECE

[75] Inventors: Robert Wolber; Roland Maurer, both of Lauterbach, Fed. Rep. of Germany

[73] Assignee: Gebruder Junghans GmbH, Schramberg, Fed. Rep. of Germany

[21] Appl. No.: 284,212

[22] Filed: Jul. 17, 1981

[30] Foreign Application Priority Data

Sep. 16, 1980 [DE] Fed. Rep. of Germany ..... 8024739

[51] Int. Cl.[3] ..... G04B 19/00; G04B 37/00

[52] U.S. Cl. ..... 368/88; 368/76; 368/316

[58] Field of Search ..... 368/76, 88, 276, 300, 368/316, 317

[56] References Cited

U.S. PATENT DOCUMENTS

| | | | |
|---|---|---|---|
| 2,665,542 | 1/1954 | Sheldon | 368/316 X |
| 4,263,667 | 4/1981 | Wolber et al. | 368/88 X |
| 4,316,277 | 2/1982 | Endo | 368/76 |

FOREIGN PATENT DOCUMENTS 2403289 7/1975 Fed. Rep. of Germany .

2839556 12/1979 Fed. Rep. of Germany .

*Primary Examiner*—J. V. Truhe
*Assistant Examiner*—Terranda L. Flower
*Attorney, Agent, or Firm*—Burns, Doane, Swecker & Mathis

[57] ABSTRACT

A timepiece drive assembly is adapted to be mounted in a timepiece housing, e.g., a small designer desk clock. The assembly includes a movement casing equipped with a removable battery-receiving member in which battery contact terminals are releasably arranged. The contact terminals are connected by means of flexible connecting lines with the circuit board of the movement. The movement casing may be arranged in a cylindrical part of the clock housing, while the battery-receiving member is located in a pedestal provided underneath the cylindrical part. It is only necessary to equip the pedestal with fastening means for the battery-receiving member and not with the more expensive individual fastening means for the holding and contacting of the battery. Thus, substantially flexibility is obtained in the design of the timepiece housing because the battery-receiving member can be connected to the movement casing or spaced therefrom.

8 Claims, 2 Drawing Figures

21
1
27
19'
26
20'
27
19'
4
10
9
5
3
9
2
6
8
9
27
7
19
17
20
27
19
12
18
16
12
18
22
25
IEC LR 1
14
14
11
11
23
15
24
13

DRIVE ASSEMBLY FOR A TIMEPIECE

BACKGROUND AND OBJECTS OF THE INVENTION

The invention concerns a timepiece drive assembly in which a circuit board is carried within a movement casing and is electrically coupled with battery contact terminals.

Such a movement casing arrangement is known for example from DE-P 28 39 556. Therein one of the two battery contact terminals is fastened directly to the circuit board, which in turn is set into the movement casing. The second battery contact terminal is secured to the movement casing itself and applied against a surface of the circuit board by means of a pressure contact for the purpose of simultaneously effecting an electrical connection and the mechanical fastening of the contact terminal by elastic and frictional mechanical means. The ends of the contacts achieving that frictional electric connection of the battery protrude into a battery chamber integral with the movement casing. The battery chamber may, for example in the case of a common casing, be separated from the movement and switching mechanism by a partition disposed inside the movement casing. As the result of the resultant simple and functionally safe assembly of the circuit board, a layout of the battery contact terminals and their arrangement of this type were found to be suitable for movement casings in large clocks, i.e., for the installation of movements in the housing of wall, standing or table clocks with or without date displays. Under certain conditions, however, the fact that the inclusion of the battery chamber in the movement casing necessitates dimensions of the latter that are larger than those required for the housing of the electronic clock circuitry and possibly of an electromechanical drive mechanism for hands and an electromechanical signal transducer device, may prove to be a disadvantage. It may restrict the desirable freedom of design in the development in particular of small cases for timepieces.

A movement for large clocks (made by KUNDO) has been marketed, wherein the two battery contact terminals are fastened to the circuit board and together with it to the movement casing, whereby they protrude freely into the battery chamber, which in turn is readily removable from the rest of the movement casing. This may be an advantage with respect to the replacement of batteries, because the used battery is removed from the casing. However, since the battery connector poles protrude into the center area of the removable battery chamber in order to contact the battery, the overall dimensions of the movement casing are essentially of the same magnitude as those of a battery chamber fixedly attached to the movement casing, i.e., for example of a battery chamber integral with the casing.

It is known from DE-AS 24 03 289 to mount an electromechanical transducer for the movement of the hands directly on the circuit board and further to provide the battery contact terminals in the form of conductor surfaces laminated onto the circuit board itself. The circuit board is not housed in its own movement casing, but is inserted directly into the timepiece housing, wherein the drive batteries are to be inserted between the laminated contact surfaces on the circuit board and a spatially coordinated part of the timepiece housing. This layout eliminates entirely the battery chamber associated with the movement casing, together with the movement casing itself. However, there occurs the disadvantage that in mass producing such circuit boards (desirable from a cost standpoint), the watch case must be adapted to the circuit board, leading to narrow design limitations, at least in relation to the internal layout of the case of the timepiece.

In view of these facts, it is the object of the invention to provide a timepiece drive assembly of the abovedescribed generic type which affords a great degree of design freedom even in timepieces whose housing presents a small volume, and nevertheless is capable of receiving a standardized, mass-produced movement case.

BRIEF SUMMARY OF THE INVENTION

This object is essentially attained according to the invention which involves a timepiece drive assembly adapted to be mounted in a housing. The assembly includes a movement casing containing a circuit board, and a battery-receiving member removably secured to the casing. The battery-receiving member includes battery contact terminals removably secured in the battery-receiving member. Flexible connecting lines extend between the battery-receiving member and the casing to electrically couple the contact terminals and the circuit board.

The battery-receiving member can be coupled to the timepiece housing rather than to the movement casing by providing a coupling element in the housing which corresponds to that of the movement casing.

When timepiece housings having a large volume are equipped with the above-mentioned assembly, the battery-receiving member may remain mounted on the movement case because of the availability of adequate space. It is not necessary for the manufacturer of the timepiece housing to mold or build inside the housing a fastening device specifically for the drive battery and possibly for its contact terminals.

On the other hand, in the case of small designer timepieces comprising a hollow, cylindrical housing resting on a block-shaped pedestal, wherein one of the frontal surfaces is the supporting surface of the watch face, the diameter of the cylinder may be so small that just the movement casing itself, i.e., containing the circuit board and possibly the electromechanical transducer with gear means, may be installed in the cylinder. In such a case, the drive battery is separated from the movement casing and installed in the pedestal of the housing, whereby the flexible connecting lines are extended between the battery connector terminals and the circuit board. The battery contact terminals themselves may be secured in the pedestal, which in turn is designed to form the battery-receiving member. However, the freedom of design is enhanced by providing the timepiece housing with a coupling in the pedestal corresponding to that of the movement casing for connection to the prefabricated battery-receiving member.

This coupling may be positively or frictionally binding, for example in the form of a push button-like snap connector. In the interest of easy mounting and disassembly without the risk of damage resulting from the overly strong hold of the movement casing on the battery-receiving member, when the latter is to be removed, it is appropriate to design a positively locking, releasable connection providing a non-tilting fastening of the battery-receiving member to the movement casing itself (or to the timepiece housing) that may readily be inspected for correct seating, particularly when designed as a tongue and slot connection.

Preferably, the battery contact terminals comprise shackle springs releasably insertable within the battery-receiving member. Thus, prior to the handling of the battery-receiving member, in particular the insertion or removal of the battery chamber, the battery contact terminals may be removed easily, so that the risk of tearing the flexible connecting lines or interference with the contacting of the circuit board, is eliminated.

The shackle springs may be inserted in slots which are defined by C-shaped profile elements. Thus, the removal or securing of the battery contact terminals is especially simple while simultaneously insuring the necessary spring path (in accordance with the thickness of the bow in the vertical angle of the terminal strap) for the frictional attachment against the battery poles, to provide secure electrical contacting.

THE DRAWING

Further characteristics and advantages of the invention will become apparent from the appended claims and the description hereinbelow of preferred examples of the embodiment for two solutions according to the invention, represented in the drawing with restriction to the essential but approximately to scale:

The FIG. 1 shows in an oblique rear elevation a battery-receiving member removed from the movement casing itself with an indication of the installation in a timepiece housing (in broken lines), with the rear wall of the movement casing removed.

The FIG. 2 shows a terminal connection directly at a part of the clock's housing.

DETAILED DESCRIPTION OF A PREFERRED EMBODIMENT OF THE INVENTION

Figure 1:
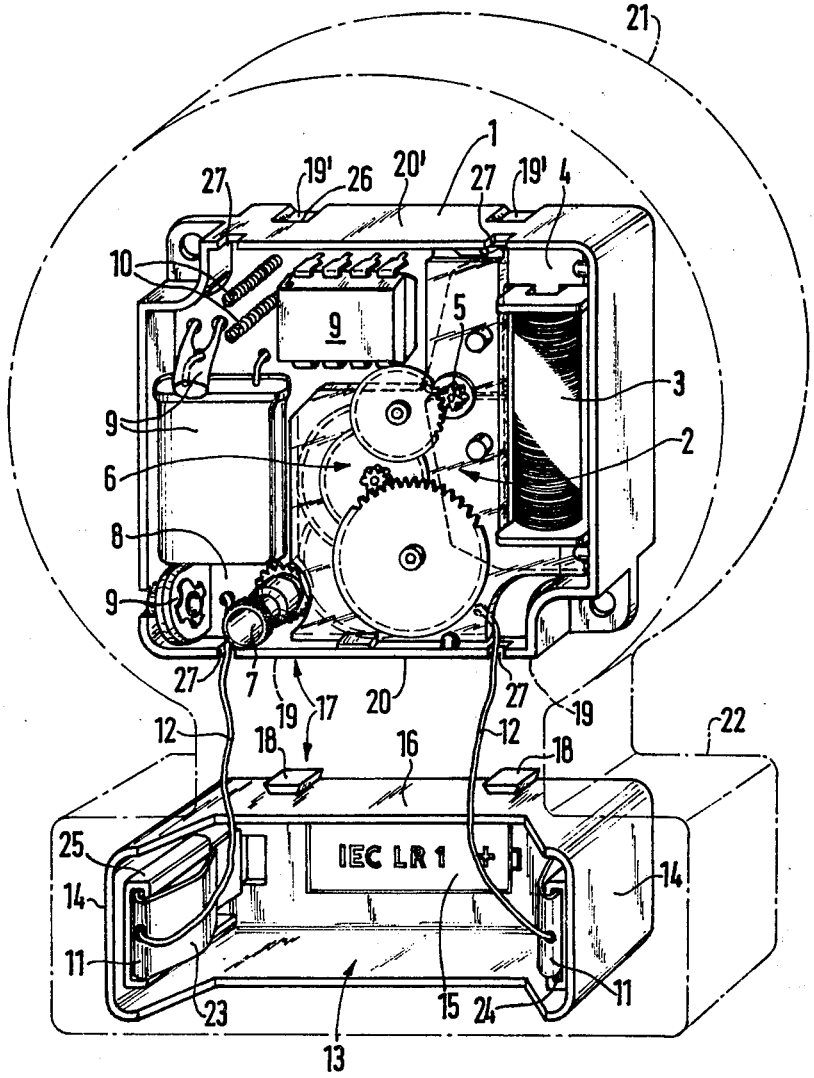

The view shown in FIG. 1 of the drawing of the open rear side of the movement casing 1 depicts a stepping motor 2, a bobbin 3, a stator core 4 and a rotor 5 to drive the gear and hand means 6, together with a setting handle 7 to adjust the setting of the hands and, in the case of a movement of a date watch equipped with a signal transducer, to set the time for the emission of the signal. A circuit board 8 carries electronic components 9 for the timekeeping circuit to drive the stepping motor 2 and the contact transducer 10 to connect with a signal transducer device (not shown) built for example into the rear wall of the movement casing (here removed), for example in the form of a Helmholtz resonator.

Battery contact terminals 11 are conducted to the circuit board 8, i.e., by means of flexible connecting lines 12 electrically connected with the associated strip conductors (not shown) on the circuit board 8. A pair of identical battery contact terminals 11 are releasably inserted in a chamber of a battery-receiving member 13, for example of the type which receives a single small rod battery (lady cell). The terminals 11 are mounted on frontal walls 14 of the battery-receiving member, without having to disconnect the lines 12.

The battery-receiving member 13 may optionally be connected to the movement casing 1 or to the timepiece housing 22, as will be discussed below. Only the connection with the housing 22 is depicted herein, with the connection to the movement casing being amply described.

The battery-receiving member itself, with the battery pole symbol 15 shown at its bottom, is separate from the movement casing 1 itself in the figure. For the releasable mutual fastening of the battery-receiving member 13 with either the housing 22 or the movement casing 1, a mating connection (a positive connection in the case of the present example) is provided in the form of at least one slot and tongue type coupling with a dovetail configuration. Preferably, the dovetail tongues 18, undercut transversely of the direction of insertion during mounting and disassembly, are molded onto the battery-receiving member 13, projecting away from the longitudinal wall 16. The complementary dovetail slots are formed in the housing 22 (slots not shown for the sake of clarity) and in the movement casing 1. In the latter case, two pairs of slots 19, 19' are formed in bottom and top walls 20, 20' of the movement casing. Those slots are molded in the casing walls and extend parallel to the axes of rotation of the gear and hand movements 6, so that the inherent dimensions of the movement casing 1 proper are not increased by any projecting connecting elements. Since slots are formed in both walls 20, 20', the battery-receiving member 13 may be mounted at the top or bottom of the movement casing 1, depending upon the particular housing size and configuration.

In the coupling 17 the slots 19, 19' include a stop 26 or a narrowing in the profile of the slots, so that the battery-receiving member 13 may be removed toward and inserted away from the face side or front of the housing where the hands are displayed. Since the movement casing 1 itself is fastened by means of a central hole mounting or by its corners disposed behind the face carrier of the watch housing part 21 (see hereinbelow), it is assured that, when the battery-receiving member 13 is mounted to the movement casing, the battery-receiving member 13 cannot become separated from the movement casing 1 even under exposure to vibration or impact (for example during the shipping of the ready assembled watch).

If adequate space is available within the timepiece housing receiving the movement casing 1, the latter may be equipped with the battery-receiving member 13 prior to its installation by means of simple insertion of the coupling 17. Otherwise, the battery-receiving member 13 (as shown in the drawing for the case of a small designer timepiece) is installed in the housing part or pedestal 22 independently of the installation of the movement casing 1 by means of dovetail slots in the pedestal. The flexible connecting lines 12 emerging from notches 27 in the walls 20 (or 20') of the movement casing, naturally must then be long, since the battery connector terminals 11 are disposed in the remote battery-receiving member 13.

It is convenient for this purpose to provide the battery contact terminals 11 in the form of U-shaped shackle springs, which may have one leg 23 removably inserted parallel to the associated frontal wall 14 of the battery-receiving member into positioning slots 24 molded onto or fastened to the wall 14.

The positioning slots 24 are appropriately defined by C-shaped profile members 25, ending at the bight area between the legs of the shackle springs standing at an angle to each other, so that the free ends of the legs have available an adequate spring path to contact the battery poles with the battery being held frictionally in the battery chamber 13, without the need for a special extension of the battery-receiving member 13, in the axial direction.

Figure 2:
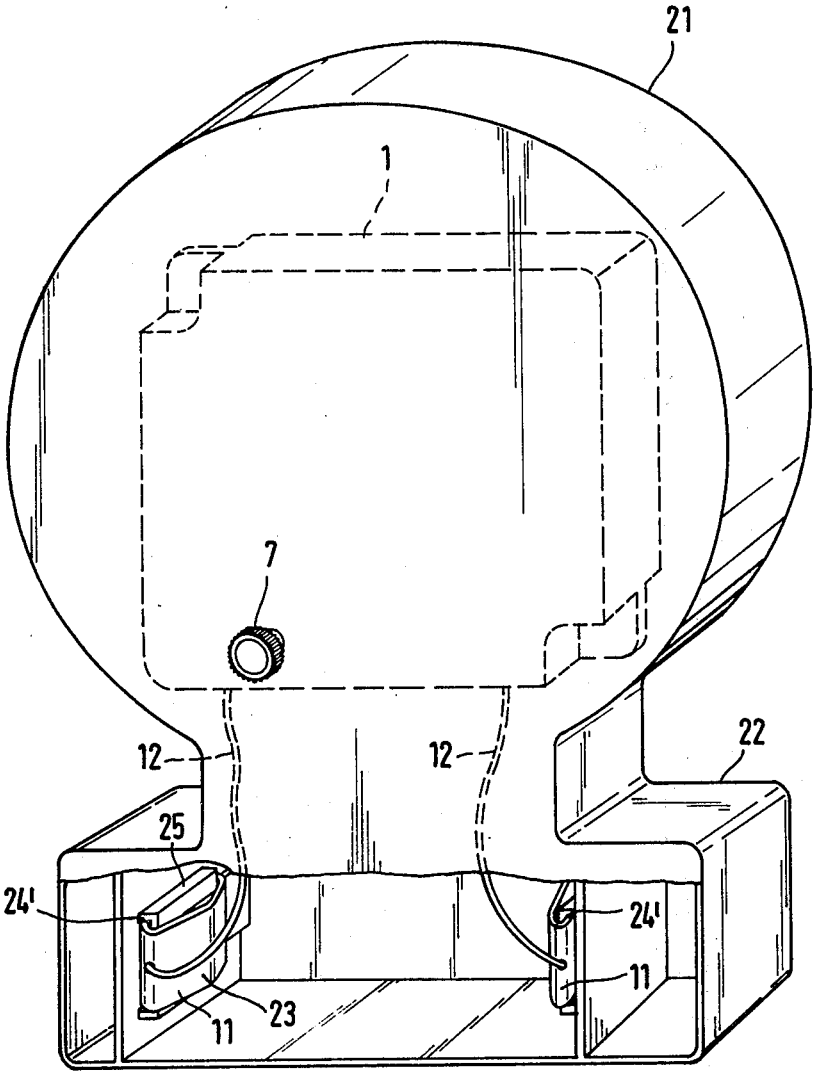

The above-described battery contact terminals may also be arranged in timepiece housing parts 21 or 22 themselves, in a manner corresponding to the one described for their removable placing in the battery-receiving member 13, if a suitably large battery space is available in the clock case, wherein the insertion of the standardized battery-receiving member 13 together with the movement casing 1 is (for design or other reasons) undesirable. That is, rather than employing a battery-receiving member 13 attached to the movement casing 1, e.g. housing part 22 would be provided with slots 24' similar to slots 24, into which the terminals 11 are removably insertable, as indicated in FIG. 2.

Although the invention has been described in connection with a preferred embodiment thereof, it will be appreciated by those skilled in the art that additions, modifications, substitutions, and deletions not specifically described may be made, without departing from the spirit or scope of the invention as defined in the appended claims.

What is claimed is:

1. A timepiece drive assembly adapted to be mounted in a timepiece housing, said assembly including:

a movement casing containing a circuit board and first mating means, a battery-receiving member having second mating means configured for removable securement with said first mating means of said casing, said battery-receiving member forming a chamber and including battery contact terminals removably secured in said chamber, and flexible connecting wires extending between said terminals and said casing to electrically couple said terminals to said circuit board, said wires being of sufficient length to permit said battery-receiving member to be separated from said casing and positioned in spaced relationship therewith within the timepiece housing while maintaining an electric coupling between said terminals and said circuit board.

2. An assembly according to claim 1, wherein said first and second mating means include cooperating coupling means forming a positively locking, releasable connection between said movement casing and said battery-receiving member.

3. An assembly according to claim 2, wherein said coupling means comprises a dovetail tongue-and-slot.

4. An assembly according to claim 1, wherein said battery contact terminals comprise shackle springs each having a pair of legs, said battery-receiving member including slots receiving one leg of said springs.

5. An assembly according to claim 4, wherein said slots are formed by C-shaped profile members.

6. An assembly according to claim 1, wherein said movement casing and battery-receiving member are installed together within a housing of a timepiece.

7. An assembly according to claim 1, wherein said member being arranged such that a battery is removable therefrom only in a first direction, said first and secondary mating means being arranged to enable said battery-receiving member to be removed only in a second direction opposite said first direction.

8. A timepiece comprising:

a housing having first mating means, a movement casing mounted in said housing and containing a circuit board, a battery-receiving member mounted in said housing separate from said movement casing, said member forming a chamber for receiving a battery and arranged such that the battery is removable from said chamber only in a first direction, said member including second mating means configured for removable securements with said first mating means and arranged to permit removal of said second mating means therefrom only in a second direction opposite said first direction, and flexible connecting wires extending between said chamber and said casing to electrically couple said terminals with said circuit board, said movement casing including third mating means similar to said first mating means for enabling said second mating means of said member to be selectively connected thereto, said wires being of sufficient length to couple said terminals with said circuit board when said battery-receiving member is connected to either of said first and third mating means.

* * * * *